US010704736B2

(12) United States Patent
Mak

(10) Patent No.: US 10,704,736 B2
(45) Date of Patent: Jul. 7, 2020

(54) LNG BOILOFF GAS RECONDENSATION CONFIGURATIONS AND METHODS

(71) Applicant: Fluor Technologies Corporation, Sugar Land, TX (US)

(72) Inventor: John Mak, Santa Ana, CA (US)

(73) Assignee: Fluor Technologies Corporation, Sugar Land, TX (US)

( * ) Notice: Subject to any disclaimer, the term of this patent is extended or adjusted under 35 U.S.C. 154(b) by 0 days.

(21) Appl. No.: 15/895,317

(22) Filed: Feb. 13, 2018

(65) Prior Publication Data

US 2018/0172212 A1 Jun. 21, 2018

Related U.S. Application Data

(62) Division of application No. 13/685,201, filed on Nov. 26, 2012, now Pat. No. 9,927,068.

(Continued)

(51) Int. Cl.

| | |
|---|---|
| ***F17C 9/02*** | (2006.01) |
| ***F17C 9/04*** | (2006.01) |
| ***F25J 1/00*** | (2006.01) |

(52) U.S. Cl.

CPC ..... *F17C 9/02* (2013.01); *F17C 9/04* (2013.01); *F25J 1/0025* (2013.01); *F17C 2201/0104* (2013.01); *F17C 2201/032* (2013.01); *F17C 2201/052* (2013.01); *F17C 2205/0326* (2013.01); *F17C 2221/033* (2013.01); *F17C 2223/0161* (2013.01); *F17C 2223/033* (2013.01); *F17C 2223/043* (2013.01); *F17C 2223/047* (2013.01);

(Continued)

(58) Field of Classification Search

CPC ..... F17C 9/00; F17C 9/02; F17C 9/04

See application file for complete search history.

(56) References Cited

U.S. PATENT DOCUMENTS

| | | | |
|---|---|---|---|
| 6,460,350 | B2 | 10/2002 | Johnson et al. |
| 6,640,556 | B2 | 11/2003 | Ursan et al. |

(Continued)

FOREIGN PATENT DOCUMENTS

| | | | |
|---|---|---|---|
| AR | 090402 | B1 | 4/2019 |
| CN | 101421554 | A | 4/2009 |

(Continued)

OTHER PUBLICATIONS

Argentine Patent Application No. P120104528, Office Action, dated Sep. 7, 2018.

(Continued)

*Primary Examiner* — John F Pettitt, III

(74) *Attorney, Agent, or Firm* — Conley Rose, PC

(57) ABSTRACT

Systems and methods for optimizing the recondensation of boiloff gas in liquid natural gas storage tanks are presented. In especially preferred aspects of the inventive subject matter, BOG from a storage tank is condensed using refrigeration content of a portion of LNG sendout in a direct or indirect manner, and the BOG condensate and LNG sendout portion are combined to form a subcooled stream that is then combined with the balance of the LNG sendout, to be fed to a high pressure pump. Contemplated recondensation operations advantageously occur without using otherwise needed large volume recondensers. Moreover, the condensing and subcooling operations are decoupled from the LNG sendout rate.

14 Claims, 5 Drawing Sheets

Related U.S. Application Data

(60) Provisional application No. 61/605,976, filed on Mar. 2, 2012, provisional application No. 61/568,970, filed on Dec. 9, 2011, provisional application No. 61/566,155, filed on Dec. 2, 2011.

(52) U.S. Cl.
CPC ..... *F17C 2227/0135* (2013.01); *F17C 2227/0178* (2013.01); *F17C 2227/0393* (2013.01); *F17C 2250/0626* (2013.01); *F17C 2250/0636* (2013.01); *F17C 2260/035* (2013.01); *F17C 2265/022* (2013.01); *F17C 2265/034* (2013.01); *F17C 2265/035* (2013.01); *F17C 2265/037* (2013.01); *F17C 2270/0136* (2013.01)

(56) References Cited

U.S. PATENT DOCUMENTS

| | | | |
|---|---|---|---|
| 6,745,576 | B1 | 6/2004 | Granger |
| 7,493,778 | B2 | 2/2009 | Engdahl |
| 7,690,365 | B2 | 4/2010 | Lee et al. |
| 8,117,852 | B2 | 2/2012 | Mak |
| 9,927,068 | B2 | 3/2018 | Mak |
| 2003/0158458 | A1 | 8/2003 | Prim |
| 2008/0034769 | A1 | 2/2008 | Engdahl |
| 2009/0217676 | A1 | 9/2009 | Mak |
| 2010/0000253 | A1 | 1/2010 | Fuchs |
| 2011/0056238 | A1 | 3/2011 | Mak |
| 2011/0132003 | A1 | 6/2011 | Pozivil et al. |

FOREIGN PATENT DOCUMENTS

| | | | |
|---|---|---|---|
| CN | 101881549 | A | 11/2010 |
| CN | 104321581 | A | 1/2015 |
| EP | 2072885 | A1 | 6/2009 |
| EP | 2372221 | A1 | 10/2011 |
| JP | 2001132899 | A | 5/2001 |
| JP | 2002338977 | A | 11/2002 |
| JP | 2008309195 | A | 12/2008 |
| JP | 05106793 | | 10/2011 |
| KR | 10-20010077227 | A | 8/2001 |
| KR | 10-20110018181 | | 2/2011 |
| WO | WO2009136793 | A1 | 11/2009 |
| WO | WO2013081979 | A1 | 6/2013 |

OTHER PUBLICATIONS

Restriction Requirement dated Dec. 10, 2014, U.S. Appl. No. 13/685,201, filed Nov. 26, 2012.
Office Action dated Apr. 6, 2015, U.S. Appl. No. 13/685,201, filed Nov. 26, 2012.
Final Office Action dated Sep. 11, 2015, U.S. Appl. No. 13/685,201, filed Nov. 26, 2012.
Office Action dated Feb. 16, 2016, U.S. Appl. No. 13/685,201, filed Nov. 26, 2012.
Office Action dated Jul. 29, 2016, U.S. Appl. No. 13/685,201, filed Nov. 26, 2012.
Final Office Action dated Jan. 13, 2017, U.S. Appl. No. 13/685,201, filed Nov. 26, 2012.
Advisory Action dated Apr. 12, 2017, U.S. Appl. No. 13/685,201, filed Nov. 26, 2012.
Notice of Allowance dated Jul. 6, 2017, U.S. Appl. No. 13/685,201, filed Nov. 26, 2012.
Notice of Allowance dated Nov. 3, 2017, U.S. Appl. No. 13/685,201, filed Nov. 26, 2012.
China Patent Application No. 201280068819.0, Office Action, dated Jul. 3, 2015.
China Patent Application No. 201280068819.0, Office Action, dated Mar. 30, 2016.
China Patent Application No. 201280068819.0, Notification to Grant Patent Right, dated Jul. 4, 2016.
International Search Report and the Written Opinion dated Feb. 28, 2013, PCT Application No. PCT/US2012/066553.
International Preliminary Report on Patentability dated Feb. 12, 2014, PCT Application No. PCT/US2012/066553.
Indian Patent Application No. 4850/DELNP/2014, Examination Report dated May 9, 2019.

Prior Art Figure 1

LNG BOILOFF GAS RECONDENSATION CONFIGURATIONS AND METHODS

CROSS-REFERENCE TO RELATED APPLICATIONS

This application claims the benefit of priority to and is a divisional of U.S. application Ser. No. 13/685,201 filed on Nov. 26, 2012 and entitled "LNG Boiloff Gas Recondensation Configurations and Methods," which claims priority to U.S. Provisional Application Nos. 61/566,155 filed on Dec. 2, 2011; 61/568,970 filed on Dec. 9, 2011; and 61/605,976 filed on Mar. 2, 2012, all of which are incorporated by reference herein.

FIELD OF THE INVENTION

The field of the invention is liquid natural gas (LNG) vapor handling, and especially as it relates to vapor recondensation during LNG storage, ship unloading, and transfer operations.

BACKGROUND

The storage and transfer of LNG poses significant challenges, particularly with respect to LNG vapor in the form of boiloff gas (BOG). While LNG is stored in a tank, the rate of BOG production is generally relatively low. However, the rate of BOG production is significantly increased upon LNG transfer into the tank, mostly due to heat from the sendout pumps and thermal losses in transfer. The variation in the amount of BOG in the tanks must be taken into account in the recondensation processes that recapture the BOG for delivery to high pressure (HP) pumps used to route sendout LNG to a vaporizer for pipeline delivery.

Typically, BOG recondensation processes employ recondensers having a relatively large volume to so allow combination of the BOG condensate with the LNG sendout to thereby form a subcooled liquid, but also to provide a surge volume for the combined LNG sendout to ensure a minimum flow rate to the high pressure pump. If the surge volume is inadequate, vapor may be introduced into the high pressure pump, which may cause cavitation in the pump, leading to component damage, decreased efficiency, and an ultimately shortened pump life. Vapor may also be introduced into the pump if the BOG condensate is a bubble liquid. Therefore, the large volume recondensers must receive an appropriate amount of LNG sendout to ensure that the combined LNG sendout contains no vapor. The variable production of BOG in the tank means variability in the amount of LNG sendout required in the recondenser operation and difficulty in optimizing the system for safe operation of the high pressure pump.

EP Publication No. 2372221A1 discloses a BOG recondenser having a bottom section that acts as a holdup drum for the high pressure pump. LNG sendout is introduced into the top section for recondensation and into the lower section, wherein the lower section receives up to half-maximum sendout, maintained by a level controller. A padding gas is then used to maintain pressure. While such recondenser may allow for at least some reduction in equipment size, the volume of held up liquid in the bottom section is still considerable.

U.S. Pat. No. 8,117,852 discloses methods and configurations for a system to unload LNG from a carrier into a storage tank. As the carrier is unloaded, the boiloff gas (BOG) in the storage tank is recondensed and sent to the storage tank. At the same time, BOG from the tank is processed in a condenser and partly recirculated to cool the incoming stream of LNG. The vapor in the resulting mixed stream is then separated and used to maintain the tank pressure on the carrier during unloading.

U.S. Pat. No. 7,493,778 discloses a condensing assembly that includes a BOG line to a traditional condenser, in which the BOG is condensed using direct contact of LNG from the sendout line. Control of the flow rate of the LNG used to condense the BOG is based entirely on active control of the liquid level in the condenser. The condenser is "ventless"; the pressure in the condenser is maintained by back pressure in the section of the sendout adjacent to the condensate line.

U.S. Application No. 2011/0056238 discloses an LNG storage and regasification plant that reliquifies BOG from the tank, uses one portion of the BOG as fuel gas, recycles another portion of the BOG back to the storage tank for tank pressure and Wobbe index control, and feeds a further portion of the BOG to the sendout line. This system uses a conventional recondenser, such as described above, on yet another BOG portion prior to sending a stream of LNG to high pressure pumps for subsequent vaporization.

These and all other extrinsic materials discussed herein are incorporated by reference in their entirety. Where a definition or use of a term in an incorporated reference is inconsistent or contrary to the definition of that term provided herein, the definition of that term provided herein applies and the definition of that term in the reference does not apply.

These systems described above fall short of a comprehensive and effective solution to all of the problems associated with BOG during LNG storage and transfer, especially as it relates to combination of the BOG condensate with the LNG sendout, and accommodation of large volume changes in the BOG. Therefore, there is still a need for improved configurations and methods of BOG handling.

SUMMARY

The inventive subject matter provides apparatus, systems, and methods in which one can recover boiloff gas (BOG) from an LNG storage tank by using a portion of the LNG sendout to produce a subcooled BOG/LNG stream for combination with subcooled sendout LNG, which is then fed to the high pressure (HP) sendout pump. Such systems advantageously avoid the need for large volumes of sendout LNG to fully subcool the BOG condensate. In preferred aspects of the inventive subject matter, BOG may be condensed and subcooled using any of several methods presented herein, which include condensation and subcooling using a portion of LNG sendout in a heat exchanger, or direct contact with the portion of LNG sendout in a recondensing vessel and subsequent subcooling using a booster pump.

Subcooling of the BOG condensate may occur concurrently with the condensation of the BOG, or it may occur in an operation subsequent to BOG condensation by using, for example, a booster pump to subcool the condensed BOG. Likewise, the combination of BOG condensate and the portion of LNG sendout used to condense the BOG may occur concurrently with or subsequent to the condensation and subcooling operations. It will be appreciated that subcooling the combined mixture of BOG condensate and portion of LNG sendout prior to recombination with the balance of the LNG sendout allows almost immediate mixing of the streams with little or no residence time and so avoids the need for relatively large surge volumes.

Moreover, the use of a portion of the LNG sendout for the BOG condensation and subcooling operations allows the operation of the BOG condensing and subcooling system to be decoupled from the rate of the remaining LNG sendout to the high pressure pump. Thus, the feed to the high pressure pump is not disrupted by fluctuations in the amount of BOG produced in the storage tank, which may be substantial.

Viewed from a different perspective, and because there is a constant flow into the high pressure pump, the condensing and subcooling system does not require a large recondenser or a mixing vessel in which the BOG condensate is combined with the sendout LNG. For example, if a recondenser is chosen for the condensing operation according to the inventive subject matter, a recondenser with substantially smaller capacity may be used, because the streams to be combined are already subcooled and so flow to the high pressure pump is not dependent on the holding capacity of the recondenser, as it is in traditional BOG recondensation operations. Additionally, the decoupling of the sendout flow from the condensation and subcooling operations also eliminates the need for the recondenser and the pump suction to operate at the same pressure. Indeed, the recondensation can occur at significantly lower pressures than the high pressure pump suction header pressure. This produces power savings and more efficient operation.

In a preferred aspect of the inventive subject matter, a method of producing a combined sendout stream of LNG and BOG condensate from a storage tank that provides a BOG stream and a sendout LNG stream includes a step of compressing the BOG stream to produce compressed BOG, a further step of condensing and subcooling a first portion of the compressed BOG using a portion of the LNG sendout stream to produce a subcooled BOG/LNG stream, and another step of combining the subcooled BOG/LNG stream with another (a second) portion of the LNG sendout stream to produce a combined subcooled sendout stream. Most preferably, the second portion of the LNG sendout stream has a flow rate that is decoupled from the steps of condensing and subcooling. The combined subcooled sendout stream is then fed to a high pressure pump.

In other aspects of the inventive subject matter, the condensing and subcooling step includes use of a heat exchanger to concurrently condense and subcool a portion of the compressed BOG, and/or includes a step of controlling pressure applied to the subcooled BOG/LNG stream using another portion of the compressed BOG.

In another contemplated aspect of the inventive subject matter, the condensing and subcooling step includes separate condensing and subcooling steps. The condensing step may be performed at a pressure that is below the suction pressure of the high pressure pump, preferably using direct contact of the compressed BOG with a portion of the LNG sendout stream in a recondenser to provide an intermediate BOG/LNG product. Additionally, a portion of the intermediate BOG/LNG product may be maintained in a surge tank that operates at a lower pressure than a suction pressure of the downstream high pressure pump and that is fluidly coupled to the high pressure pump. Preferably, the subcooling step may be performed using a booster pump to form the subcooled BOG/LNG stream by increasing the pressure of the intermediate BOG/LNG product to the suction pressure of the high pressure pump.

In another preferred aspect of the inventive subject matter, a method of producing a combined sendout stream of LNG and BOG condensate from a storage tank that provides a BOG stream and a sendout LNG stream includes a step of compressing the BOG stream to produce compressed BOG, a further step of condensing the compressed BOG with a portion of the LNG sendout stream to produce an intermediate BOG/LNG product at one pressure, and another step of pumping the intermediate BOG/LNG product to a higher pressure to provide a subcooled BOG/LNG stream. The subcooled BOG/LNG stream is then combined with another portion of the LNG sendout stream to produce a combined subcooled sendout stream, which is then fed to a high pressure pump.

In a preferred aspect of the inventive subject matter, a portion of the intermediate BOG/LNG product may be maintained in a surge tank that is fluidly coupled to the downstream high pressure pump. In other aspects, the condensing step may be performed using a heat exchanger in which a portion of the LNG sendout stream provides refrigeration content, or the condensing step may be performed using direct contact of the compressed BOG and the first portion of the LNG sendout stream. Preferably, the step of condensing may be performed at a pressure that is below the suction pressure of the high pressure pump.

Consequently, an LNG processing plant is contemplated that includes a compressor that compresses a BOG stream of an LNG storage tank to produce compressed BOG, a condensing and subcooling system that receives the compressed BOG and a portion of an LNG sendout stream to produce a subcooled BOG/LNG stream, a flow control element coupled to the condensing and subcooling system to receive a second portion of the LNG sendout stream and the subcooled BOG/LNG stream to so produce a combined subcooled sendout stream, and a high pressure pump that receives the combined subcooled sendout stream.

In still another preferred aspect of the inventive subject matter, the condensing and subcooling system includes a heat exchanger that uses refrigeration content of a portion of the LNG sendout stream to condense and subcool the compressed BOG. The condensing and subcooling system may include separate condensing and subcooling devices that are fluidly coupled to each other.

In other aspects of the inventive subject matter, the separate condensing device may be a recondenser. Additionally, the separate subcooling device may be a booster pump, and the plant may include a surge tank that is fluidly coupled to the downstream high pressure pump, the condensing and subcooling system, and the booster pump.

Various objects, features, aspects, and advantages of the inventive subject matter will become more apparent from the following detailed description of preferred embodiments, along with the accompanying drawing figures in which like numerals represent like components.

DETAILED DESCRIPTION

Figure 1:
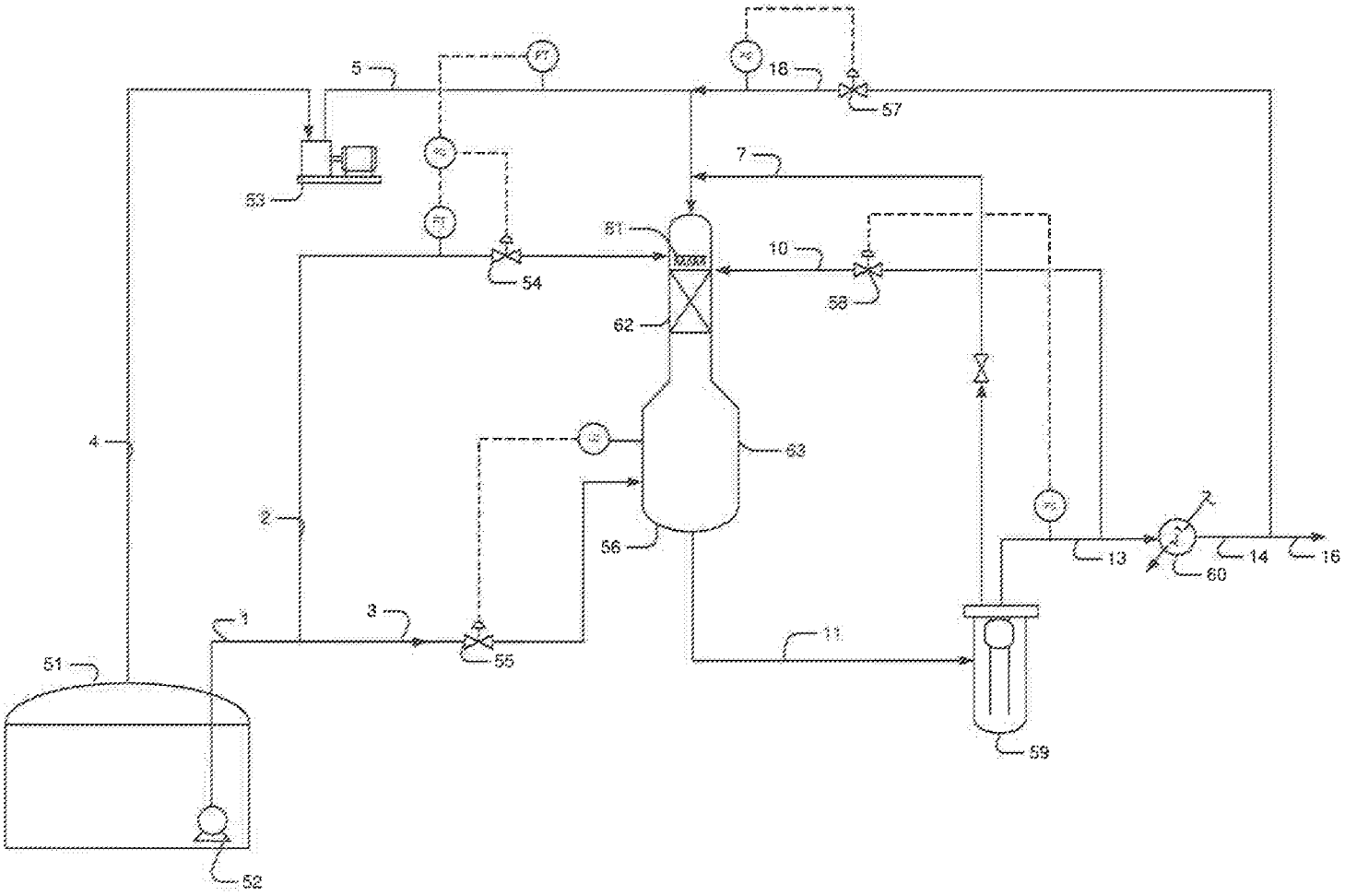
FIG. 1 is an exemplary schematic of a prior art BOG recondenser system.

The inventor has now discovered that recondensation systems for boiloff gas (BOG) in liquid natural gas (LNG)

storage tanks may be improved where processing the BOG is decoupled from the flow rate of sendout LNG from the tank by combining subcooled BOG condensate with the sendout LNG. Most preferably, the BOG is condensed and subcooled using refrigeration content of a portion of the sendout LNG, while the balance of the sendout LNG is sent to a high pressure pump. After the BOG is condensed and subcooled, the subcooled BOG/LNG stream is then combined with the balance of the sendout LNG to provide a combined subcooled sendout stream that is then fed to the high pressure pump. Decoupling of the condensing and subcooling system from the LNG sendout rate advantageously allows reduction, or even elimination, of the need for large volumes of subcooled liquid in the recondensation system to ensure the safety of the high pressure pump. The high pressure pump is fed, at a minimum, from the balance of the LNG sendout, and subcooled LNG from the BOG is combined with that stream when necessary. Thus, large or small volumes of BOG may be processed without upsetting the system.

Moreover, as the BOG condensate and the LNG sendout portion exit the condensing and subcooling operation as a subcooled BOG/LNG stream, combination with the balance of the LNG sendout stream is almost immediate. Accordingly, the inventive subject matter does not require any mixing vessel to combine the subcooled BOG/LNG stream and the balance of the LNG sendout to produce a combined subcooled sendout stream. Thus, variability in production of BOG in the tank is no longer an issue with respect to the high pressure pump.

The inventive subject matter includes embodiments designed for use with systems which require frequent startup or shutdown of the high pressure pump. Where desired, a surge tank may be present that maintains a volume of intermediate BOG/LNG product to protect against level and pressure fluctuations. A booster pump within such a surge tank may then be used to produce the subcooled BOG/LNG stream, which is combined with the balance of the LNG sendout stream as described herein.

The following discussion provides many example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

To illustrate the advantages of the inventive subject matter over previously known configurations and methods, a typical prior art receiving terminal is shown in Prior Art FIG. 1. LNG in a storage tank 51, typically having a capacity of 160,000 cubic meters, is pumped using a low pressure (LP) sendout pump 52 to about 10 barg to form LNG sendout stream 1. A BOG stream 4, typically at about 0.1 barg and −150° C., flows from the storage tank 51 and is fed to a BOG compressor 53, to produce a compressed BOG stream 5, at about 8 barg and −20° C.

Unless the context dictates the contrary, all ranges set forth herein should be interpreted as being inclusive of their endpoints, and open-ended ranges should be interpreted to include commercially practical values. Similarly, all lists of values should be considered as inclusive of intermediate values unless the context indicates the contrary. As used herein, the term "about" in conjunction with a numeral refers to a range of ±10% of that numeral, inclusive of the endpoints.

The compressed BOG stream 5 is fed to the top of a recondenser 56, where it contacts a first portion 2 of the LNG sendout stream 1 that is controlled by flow valve 54. The flow rate of the first portion 2 of the LNG sendout stream 1 is controlled by a flow ratio controller using a flow ratio of the first portion 2 of the LNG sendout to compressed BOG stream 5. Typically, the flow rate of the first portion 2 of the LNG sendout is about 6 to 7 times greater than the flow rate of the compressed BOG stream 5, which is sufficient to produce saturated LNG (a bubble point liquid) at about −140° C. and 8 barg pressure.

The recondenser 56 includes an upper section 62 and a lower section 63. The upper section includes a liquid distributor 61 and a packing section for heat transfer. The compressed BOG stream 5 contacts the first portion 2 of the LNG sendout stream 1 in upper section 62, condensing the BOG. The BOG condensate and the first portion 2 of the LNG sendout stream then mix in the lower section 63. The lower section 63 also receives a second portion 3 (the balance) of the LNG sendout, using level controller 55.

After exiting the recondenser 56, the condensate/sendout mixture 11, at about −150° C., is fed to the suction pump header of the HP pump 59, and pumped to form HP LNG sendout stream 13 at about 100 barg. The HP sendout pump minimum flow stream 10, using flow controller 58, and the HP pump vent gas stream 7 are sent back to the recondenser 56. The HP LNG sendout stream 13 is heated in an LNG vaporizer 60, producing an HP natural gas stream 14. A portion 18 of the HP natural gas stream 14 is sent back to control the pressure in the recondenser 56 using pressure control valve 57, and the majority 16 of the HP natural gas stream 14 is sent to the pipeline.

It should be appreciated that the lower section 63 of the recondenser 56 is designed for mixing the BOG condensate with both portions of the sendout LNG, and must necessarily accommodate a very large volume for this purpose. Typically, a minimum of two minutes residence time is required for mixing. The lower section 63 provides the surge volume to feed the high pressure pump 59. Inadequate surge volumes maintained in lower section 63 will result in entrainment of vapor in the pump 59, causing vibration problems in the system and likely damage to the pump. Moreover, the recondenser 56 must be designed to withstand the high pressure of the natural gas in portion 62 to protect the system from failure through over-pressurization. The design requires expensive components, is costly to maintain, and is inefficient. Failure of the system may result in unstable and hazardous conditions, and most significantly, this design is unsuitable for offshore LNG terminals.

Figure 2:
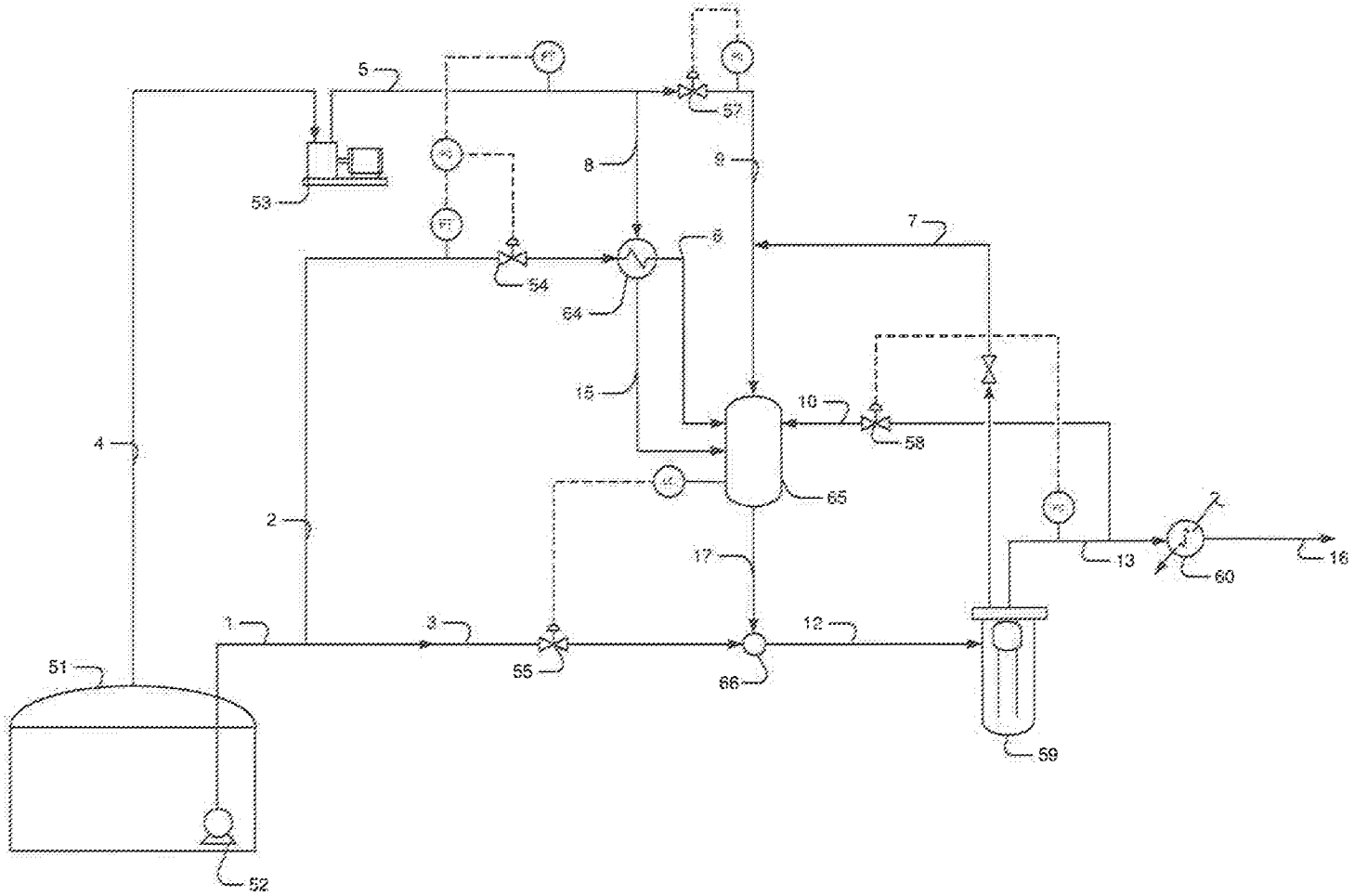
FIG. 2 is an exemplary schematic of a BOG recondenser exchanger system according to the inventive subject matter.

An exemplary configuration of the inventive subject matter, suitable for offshore LNG terminals, is shown in FIG. 2. LNG in a storage tank 51, typically having a capacity of 160,000 cubic meters, is pumped using a low pressure sendout pump 52 to about 10 barg to form LNG sendout stream 1. A BOG stream 4, typically at about 0.1 barg and −150° C., flows from the storage tank 51 and is fed to a BOG compressor 53, to produce a compressed BOG stream 5, at about 8 barg and −20° C.

In this design, the compressed BOG stream 5 is fed to a heat exchanger 64 as stream 8 and cooled by a first portion 2 of the LNG sendout stream, using flow control valve 54. The flow rate of the first portion 2 of the LNG sendout stream is controlled by a flow ratio controller using a flow ratio of the first portion 2 of the LNG sendout to compressed BOG stream 5. Typically, the flow rate of the first portion 2 of the LNG sendout is about 9 to 15 times greater than the flow rate of the compressed BOG stream 5. The BOG is condensed, producing a subcooled BOG condensate stream 15 exiting the heat exchanger 64. A subcooled LNG stream 6, produced from first portion 2 of the LNG sendout stream, also exits the heat exchanger 64.

The subcooled streams 6 and 15 are fed into a mixing vessel 65, and exit as a subcooled BOG/LNG stream 17. The subcooled BOG/LNG stream 17 is then combined with the second portion 3 (the balance) of the LNG sendout stream, using flow control element 66, to produce a combined subcooled sendout stream 12. The flow rate of the second portion 3 of the LNG sendout is controlled by control valve 55. After exiting the mixing vessel 65, the combined subcooled sendout stream 12, at about −150° C., is fed to the suction pump header of the HP pump 59, and pumped to form HP LNG sendout stream 13 at about 100 barg. The HP sendout pump minimum flow stream 10, using flow controller 58, is sent back to the mixing vessel 65. The HP combined sendout stream 13 is heated in an LNG vaporizer 60, producing an HP natural gas stream 16 that is sent to the pipeline.

It is important to realize that the mixing vessel 65 is not a recondensing vessel, as in Prior Art FIG. 1, has no internal mixing structures or packing, and does not need to accommodate large volumes. The pressure in the mixing vessel is typically maintained at about 8 barg using a second portion 9 of the compressed BOG stream, which is controlled by control valve 57, and the HP pump vent gas stream 7 is directed into this pressure stream as well. Mixing two subcooled streams is complete, almost instantaneous, and requires no residence time, eliminating the need for large volume retention. Additionally, flow control element 66 has no mixing volume for ensuring that a subcooled combined liquid is formed and requires no mixing elements; it merely combines the streams as they flow through it. By way of example, and not limitation, flow control element 66 may include T-joints, static mixers, or other such connections and components.

This system provides not only more efficiency and cost effectiveness, but also more safety. The high pressure natural gas is not fed back into the system after vaporization, meaning that the risks of high pressure are avoided in the condensing and subcooling operation. The mixture of subcooled liquid streams requires no additional equipment to facilitate and no further processing to feed the HP pump. Moreover, the system responds to the fluctuations in the amount of BOG produced in the tank, and continues to provide sufficient volume to the HP pump to prevent vibration issues or failure.

Figure 3:
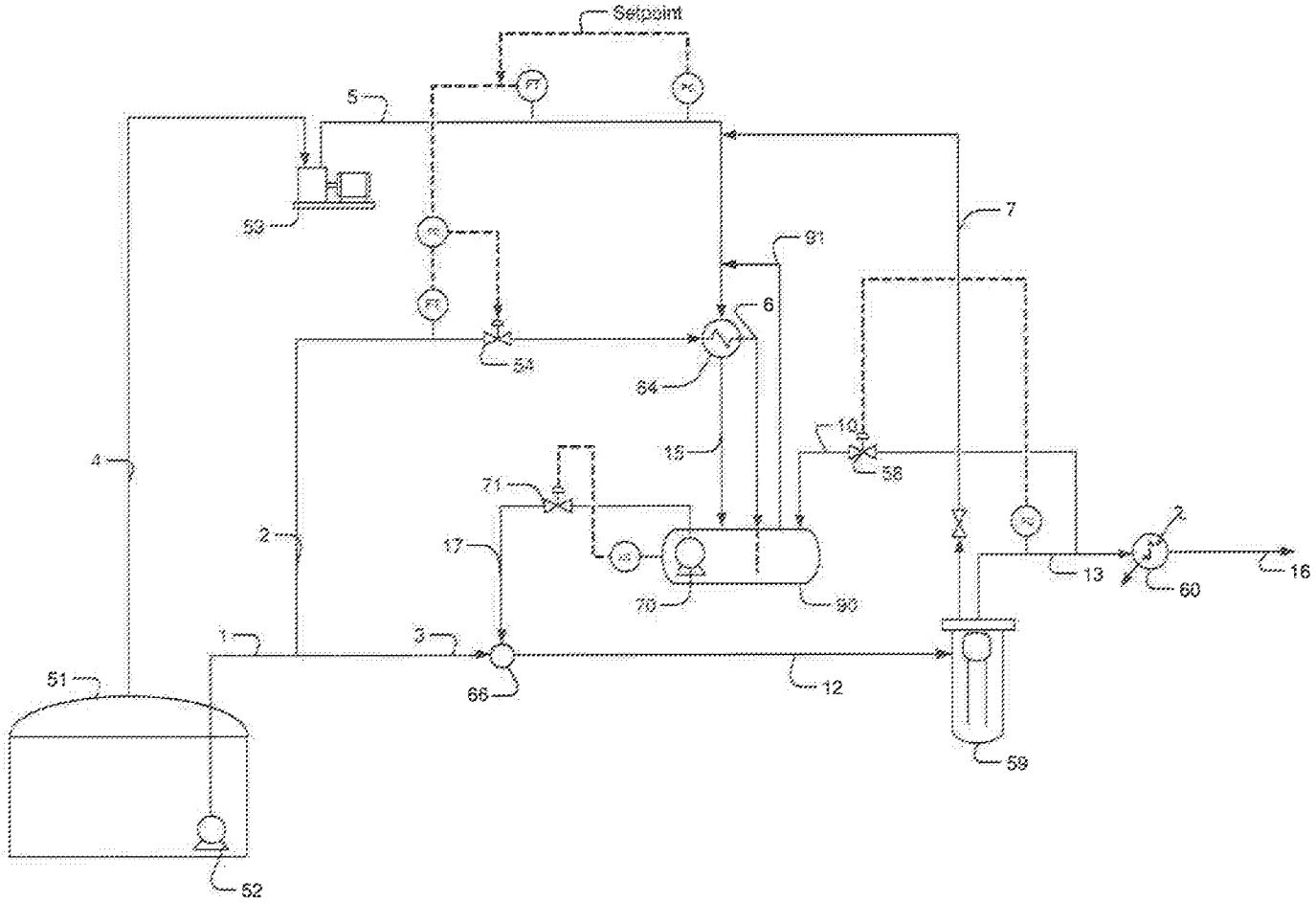
FIG. 3 is an exemplary schematic of a BOG recondenser exchanger system with a booster pump suction drum according to the inventive subject matter.

The heat exchange configuration depicted in FIG. 2 may be adapted to deal with systems requiring frequent startup or shutdown of the HP pump, which may lead to large fluctuations in the system and the associated problems with high variability of BOG. A second exemplary configuration of the inventive subject matter, suitable for systems requiring frequent startup or shutdown of the HP pump, is shown in FIG. 3. LNG in a storage tank 51, typically having a capacity of 160,000 cubic meters, is pumped using a low pressure sendout pump 52 to about 10 barg to form LNG sendout stream 1. A BOG stream 4, typically at about 0.1 barg and −150° C., flows from the storage tank 51 and is fed to a BOG compressor 53, to produce a compressed BOG stream 5, at about 8 barg and −20° C.

In this design, the compressed BOG stream 5 is fed to a heat exchanger 64 and cooled by a first portion 2 of the LNG sendout stream, using flow control valve 54. The flow rate of the first portion 2 of the LNG sendout stream is controlled by a flow ratio controller using a flow ratio of the first portion 2 of the LNG sendout to BOG stream 5. Typically, the flow rate of the first portion 2 of the LNG sendout is about 9 to 15 times greater than the flow rate of the compressed BOG stream 5. The BOG is condensed, producing a subcooled BOG condensate stream 15 exiting the heat exchanger 64. A subcooled LNG stream 6, produced from first portion 2 of the LNG sendout stream, also exits the heat exchanger 64.

The subcooled streams 6 and 15 are fed into a suction drum or surge tank 90 that is designed with surge volume for the HP pump 59. The surge volume is dictated by the operating conditions of the system. The surge tank 90 must be large enough to receive the intermediate BOG/LNG product produced by the BOG condensate and the first portion 2 of the LNG sendout stream at maximum flow of the BOG stream 4 for at least 1 minute. More preferably, the surge tank 90 would be large enough to receive a volume of intermediate BOG/LNG product at maximum flow of the BOG stream 4 for at least 2 minutes, and most preferably, at maximum flow of the BOG stream 4 for at least 10 minutes.

A booster pump 70, preferably inside in the surge tank 90, pumps the intermediate BOG/LNG product, producing a subcooled BOG/LNG stream 17, which is then combined with the second portion 3 (the balance) of the LNG sendout stream, using flow control element 66, to produce a combined subcooled sendout stream 12. The flow rate of the intermediate BOG/LNG product is controlled by control valve 71.

The combined subcooled sendout stream 12, at about −150° C., is fed to the suction pump header of the HP pump 59, and pumped to form HP LNG sendout stream 13 at about 100 barg. The HP sendout pump minimum flow stream 10, using flow controller 58, is sent back to the surge tank 90. The HP LNG sendout stream 13 is heated in an LNG vaporizer 60, producing an HP natural gas stream 16 that is sent to the pipeline. The vent gas stream 91 from the surge tank 90 is fed back into the compressed BOG stream 5, as is the HP pump vent gas stream 7.

It should again be appreciated that mixing the subcooled BOG/LNG stream 17 with the second portion 3 of the LNG sendout requires no mixing vessel or residence time. The addition of the surge tank 90 provides surge volume for stable operation during frequent startup and shutdown of the HP pump and for large variations in the flow of the BOG stream 4 without interfering with the condensing and subcooling operation. Although the surge tank 90 may contain a volume of liquid, this volume is, in most cases, relatively small compared to that of conventional recondensers.

Figure 4:
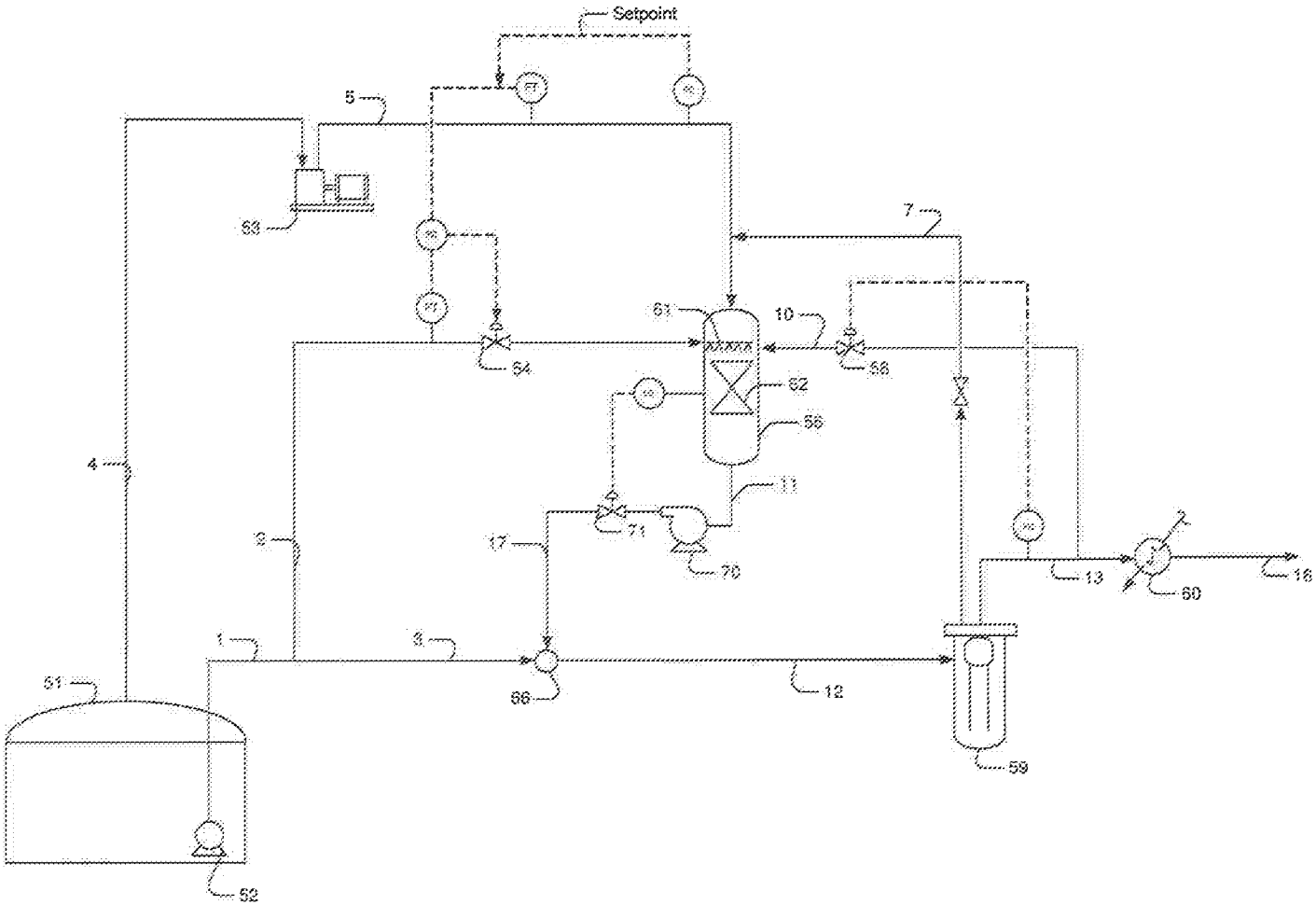
FIG. 4 is an exemplary schematic of a BOG recondenser vessel system according to the inventive subject matter.

Heat exchange configurations, such as those depicted in FIGS. 2 and 3 are limited by the surface area of the heat exchanger itself. As systems increase in size and associated volume, the heat exchange configuration requires larger and larger heat exchangers, which quickly becomes both impractical and economically undesirable. A third exemplary configuration of the inventive subject matter, suitable for larger LNG terminals, such as those exceeding a 1.5 BCFD sendout rate, is depicted in FIG. 4. LNG in a storage tank 51, typically having a capacity of 160,000 cubic meters, is pumped using a low pressure sendout pump 52 to about 10 barg to form LNG sendout stream 1. A BOG stream 4, typically at about 0.1 barg and −150° C., flows from the storage tank 51 and is fed to a BOG compressor 53, to produce a compressed BOG stream 5, at about 8 barg and −20° C.

In this configuration, the compressed BOG stream 5 is fed into a recondenser 56, where it contacts a first portion 2 of the LNG sendout stream (about 5% of the total LNG sendout), using flow control valve 54. The flow rate of the first portion 2 of the LNG sendout stream is controlled by a flow ratio controller using a flow ratio of the first portion 2 of the LNG sendout divided by compressed BOG stream 5. Typically, the flow rate of the first portion 2 of the LNG sendout is about 6 to 7 times greater than the flow rate of the compressed BOG stream 5, which is sufficient to produce a saturated LNG (a bubble point liquid) at about −140° C. and 8 barg pressure. An intermediate BOG/LNG product 11 (saturated) exits the recondenser 56, where it is then pumped using a booster pump 70 to about 10 barg, to form a subcooled BOG/LNG stream 17. The subcooled BOG/LNG stream 17 is then combined with the second portion 3 (the balance) of the LNG sendout stream, using flow control element 66, to produce a combined subcooled sendout stream 12. The flow rate of the intermediate BOG/LNG product is controlled by control valve 71.

The combined subcooled sendout stream 12, at about −150° C., is fed to the suction pump header of the HP pump 59, and pumped to form HP LNG sendout stream 13 at about 100 barg. The HP sendout pump minimum flow stream 10, using flow controller 58, is sent back to the recondenser 56. The HP pump vent gas stream 7 is fed back to the recondenser 56. The HP LNG sendout stream 13 is heated in an LNG vaporizer 60, producing an HP natural gas stream 16 that is sent to the pipeline.

The recondenser 56 includes an upper section 62 having a liquid distributor 61 and a packing section for heat transfer. Compared to prior art, the lower section of the recondenser is of a relatively small volume, because a large volume is not needed to accommodate the BOG condensate and the total LNG sendout flow. It is a hallmark of the inventive subject matter than the LNG sendout mixing occurs outside the recondenser vessel by mixing two subcooled streams. The pressure of the recondenser is maintained by adjusting the flow ratio controller that determines the quantity of LNG.

It should be appreciated that the second portion 3 (the balance) of the LNG sendout stream is sent to the HP pump without throttling that is required for liquid level control in conventional recondenser design. Significant power savings are realized in large LNG regasification plants when the LNG flow to the recondenser is relatively small compared to the total LNG sendout flow. Again, the pumping of the BOG condensate mixture produces a subcooled stream that can be mixed with the balance of the LNG sendout without any mixing equipment. Flow control element 66 is not a mixing vessel, nor does it require retention of any volumes to ensure that a subcooled combined liquid is formed.

Figure 5:
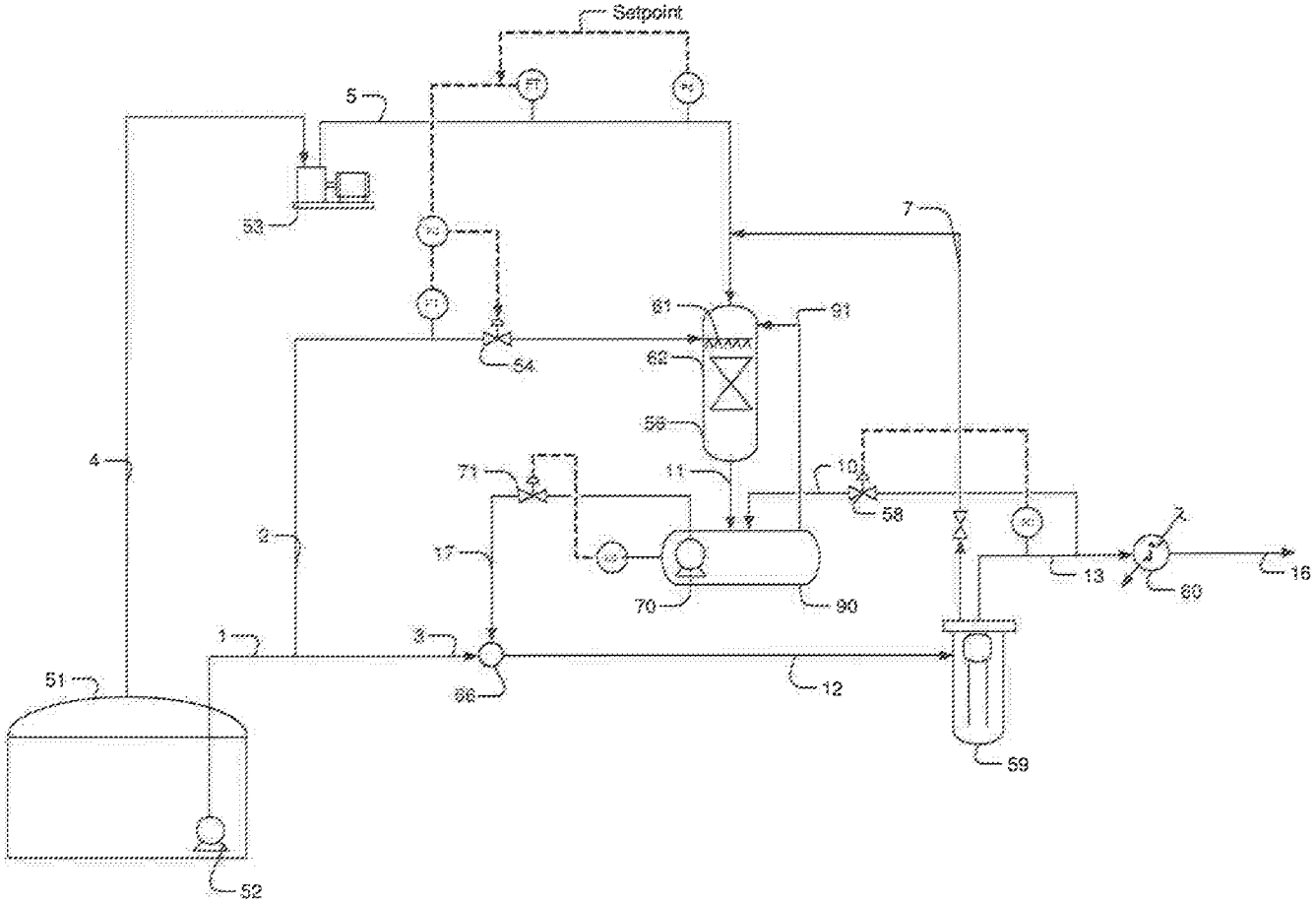
FIG. 5 is an exemplary schematic of another BOG recondenser vessel system with a booster pump suction drum according to the inventive subject matter.

Similar to the modifications to the configuration shown in FIG. 2 that are shown in FIG. 3, the configuration depicted in FIG. 4 may be adapted to accommodate systems requiring frequent startup and shutdown of the HP pump and the associated fluctuation and variability problems. FIG. 5 shows a configuration adapted to address these issues as a fourth exemplary configuration of the inventive subject matter. LNG in a storage tank 51, typically having a capacity of 160,000 cubic meters, is pumped using a low pressure sendout pump 52 to about 10 barg to form LNG sendout stream 1. A BOG stream 4, typically at about 0.1 barg and −150° C., flows from the storage tank 51 and is fed to a BOG compressor 53, to produce a compressed BOG stream 5, at about 8 barg and −20° C.

In this configuration, the compressed BOG stream 5 is fed into a recondenser 56, where it contacts a first portion 2 of the LNG sendout stream (about 5% of the total LNG sendout), using flow control valve 54. The flow rate of the first portion 2 of the LNG sendout stream is controlled by a flow ratio controller using a flow ratio of the first portion 2 of the LNG sendout to compressed BOG stream 5. An intermediate BOG/LNG product 11 (saturated) exits the recondenser 56, where it is then fed into a suction drum or surge tank 90 that is designed with surge volume for the HP pump 59. The surge tank 90 must be large enough to receive the intermediate BOG/LNG product produced by the BOG condensate and the first portion 2 of the LNG sendout stream at maximum flow of the BOG stream 4 for at least 1 minute. More preferably, the surge tank 90 would be large enough to receive a volume at maximum flow of the BOG stream 4 for at least 2 minutes, and most preferably, at maximum flow of the BOG stream 4 for at least 10 minutes.

A booster pump 70, preferably inside in the surge tank 90, pumps the intermediate BOG/LNG product, producing a subcooled BOG/LNG stream 17, which is then combined with the second portion 3 (the balance) of the LNG sendout stream, using flow control element 66, to produce a combined subcooled sendout stream 12. The flow of the intermediate BOG/LNG product is controlled by control valve 71.

The combined subcooled sendout stream 12, at about −150° C., is fed to the suction pump header of the HP pump 59, and pumped to form HP LNG sendout stream 13 at about 100 barg. The HP combined sendout stream 13 is heated in an LNG vaporizer 60, producing an HP natural gas stream 16 that is sent to the pipeline. The HP sendout pump minimum flow stream 10, using flow controller 58, is sent back to the surge tank 90. The HP pump vent gas stream 7 is sent back to the recondenser 56. The vent gas stream 91 from the surge tank is fed back to the recondenser 56.

In heretofore known methods and configurations, such as that shown in Prior Art FIG. 1, the recondenser and the HP suction pump header must operate at the same pressure because the HP pump must be vented to the recondenser, which must be elevated above the HP pump. These requirements are critical in the design and operation of prior art systems. In contrast, the configurations and methods of the inventive subject matter allow the recondenser to run at a lower pressure than the HP pump suction. Under these conditions, the pump vent (at a higher pressure) may be sent to the recondenser, which does not have to be elevated. The configurations and methods of the inventive subject matter may be employed as a retrofit to stabilize the operation of existing facilities, as well as in new construction.

It should be apparent to those skilled in the art that many more modifications besides those already described are possible without departing from the inventive concepts herein. The inventive subject matter, therefore, is not to be restricted except in the scope of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. A method of producing a combined sendout stream of liquid natural gas (LNG) and boiloff gas (BOG) condensate from a storage tank configured to provide a BOG stream and a sendout LNG stream, comprising:

compressing the BOG stream to thereby produce compressed BOG;

condensing, in a recondenser, at least a first portion of the compressed BOG using a first portion of the LNG sendout stream to thereby produce an intermediate BOG/LNG stream at a first pressure;

passing the intermediate BOG/LNG stream from the recondenser to a surge tank, wherein the surge tank is a separate vessel from the recondenser;

pumping the intermediate BOG/LNG stream from the surge tank with a pump to provide a subcooled BOG/LNG stream at a second pressure;

combining the subcooled BOG/LNG stream with a second portion of the LNG sendout stream to thereby produce a combined subcooled sendout stream;

feeding the combined subcooled sendout stream to a high pressure pump;

pumping the combined subcooled sendout stream with the high pressure pump to form a high pressure LNG sendout stream; and recirculating a portion of the high pressure LNG sendout stream to the surge tank.

2. The method of claim 1, wherein the condensing step is separate from the subcooling step.

3. The method of claim 2, wherein the step of condensing is performed at a pressure that is below a suction pressure of the high pressure pump.

4. The method of claim 1, further comprising: maintaining a portion of the subcooled BOG/LNG stream in the surge tank that operates at a lower pressure than a suction pressure of the high pressure pump and is fluidly coupled to the downstream high pressure pump.

5. The method of claim 4, wherein the pumping increases a pressure of the intermediate BOG/LNG stream to the suction pressure of the high pressure pump to thereby form the subcooled BOG/LNG stream.

6. The method of claim 1, wherein the step of condensing is performed at a pressure that is below a suction pressure of the high pressure pump.

7. The method of claim 1, further comprising:

maintaining, in the surge tank, an amount of the intermediate BOG/LNG product produced in the condensing step for at least 10 minutes.

8. The method of claim 1, further comprising:

controlling a flow rate of the first portion of the LNG sendout stream using a flow ratio controller using a ratio of the flow rate of the first portion of the LNG sendout stream to the flow rate of the compressed BOG.

9. The method of claim 1, wherein the pump is located inside of the surge tank.

10. The method of claim 1, wherein the method further comprises: sending a vent gas stream from the high pressure pump to the recondenser.

11. The method of claim 1, wherein the portion of the high pressure LNG sendout stream is at the first pressure in the surge tank.

12. The method of claim 1, wherein the first portion of the LNG sendout stream is about 5% of a flow rate of the LNG sendout stream.

13. The method of claim 1, wherein the intermediate BOG/LNG stream is a saturated liquid.

14. The method of claim 1, wherein the method further comprises: feeding a vent gas stream from the surge tank to the recondenser.

* * * * *